US010102952B2

(12) United States Patent
Pagenkopf

(10) Patent No.: US 10,102,952 B2
(45) Date of Patent: Oct. 16, 2018

(54) ADJUSTABLE INDUCTOR

(71) Applicant: Hubbell Incorporated, Shelton, CT (US)

(72) Inventor: Kenneth E. Pagenkopf, Shorewood, WI (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/704,118

(22) Filed: May 5, 2015

(65) Prior Publication Data

US 2015/0318097 A1 Nov. 5, 2015

Related U.S. Application Data

(60) Provisional application No. 61/988,788, filed on May 5, 2014.

(51) Int. Cl.

| | |
|---|---|
| ***H01F 21/06*** | (2006.01) |
| ***H01F 17/06*** | (2006.01) |
| ***H01F 27/24*** | (2006.01) |
| ***H01F 7/06*** | (2006.01) |
| ***H01F 3/14*** | (2006.01) |
| *H01F 41/08* | (2006.01) |
| *H01F 3/10* | (2006.01) |

(52) U.S. Cl.

CPC ..... *H01F 3/14* (2013.01); *H01F 21/06* (2013.01); *H01F 41/08* (2013.01); *H01F 2003/106* (2013.01); *Y10T 29/49075* (2015.01)

(58) Field of Classification Search

CPC . H01F 3/14; H01F 21/06; H01F 41/08; H01F 17/062; H01F 17/06; H01F 2003/106; H01F 21/065; H01F 3/08; H01F 27/245; H01F 27/25; H01F 27/255; H01F 27/26; Y10T 29/49075

USPC ... 336/20, 178, 234, 134, 233, 210, 118, 10, 336/212, 87, 30, 40, 132; 29/606

See application file for complete search history.

(56) References Cited

U.S. PATENT DOCUMENTS

| | | | | |
|---|---|---|---|---|
| 2,165,055 A * | 7/1939 | Kafka | H02M 7/08 | 336/134 |
| 2,550,127 A * | 4/1951 | Specht | H01F 27/25 | 29/605 |
| 2,879,489 A | 3/1959 | Mitchell | | |
| 3,197,721 A * | 7/1965 | Bogotch | H01F 17/062 | 333/171 |
| 3,518,595 A * | 6/1970 | Dawson | H01F 27/004 | 324/207.16 |
| 3,743,974 A * | 7/1973 | Sheffield | H03H 7/40 | 333/17.1 |

(Continued)

OTHER PUBLICATIONS

PCT/US2015/029170 International Search Report and Written Opinion dated Jul. 28, 2015.

*Primary Examiner* — Mangtin Lian

(74) *Attorney, Agent, or Firm* — Michael Best & Friedrich, LLP

(57) ABSTRACT

An adjustable inductor and a method of assembling such an inductor. The inductor may include a toroidal core defining a pair of gaps to provide a removable core section, the core also including a rigid core section; compressible gap material positioned in the gaps; windings wound on the rigid core section; and force-applying structure operable to apply a force to the removable core section to adjust the gaps and thereby the inductance.

26 Claims, 6 Drawing Sheets

(56) References Cited

U.S. PATENT DOCUMENTS

| | | | | |
|---|---|---|---|---|
| 3,792,399 | A * | 2/1974 | McLyman | H01F 27/263 100/8 |
| 3,824,517 | A | 7/1974 | Hess et al. | |
| 4,620,144 | A | 10/1986 | Bolduc | |
| 5,999,077 | A | 12/1999 | Hammond et al. | |
| 2001/0020887 | A1* | 9/2001 | Larikka | H01F 27/266 336/229 |
| 2002/0056186 | A1* | 5/2002 | De Graaf | H01F 3/14 29/606 |
| 2007/0090916 | A1 | 4/2007 | Rao | |
| 2009/0289755 | A1* | 11/2009 | Yu | H01F 27/36 336/84 R |
| 2012/0044033 | A1* | 2/2012 | Kawaguchi | H01F 3/14 336/90 |
| 2015/0042437 | A1* | 2/2015 | White | H01F 27/325 336/196 |

* cited by examiner

ADJUSTABLE INDUCTOR

RELATED APPLICATION

The present application claims the benefit of co-pending U.S. Provisional Patent Application No. 61/988,788, filed May 5, 2014, the entire contents of which is hereby incorporated by reference.

FIELD

The present invention relates generally to electrical components, such as inductors, and, more particularly, to cut toroidal inductors.

SUMMARY

Existing distributed and discretely gapped toroidal core inductors can only be adjusted by adding or removing turns or repositioning wires on the core after winding. Toroidal core properties are fixed at core assembly and cannot be changed after winding.

Adding and removing turns can result in only integer changes of value—inductance is proportional to turns squared. Repositioning windings can have negligible effect and is not easily repeatable. Normally, an inductor of, for example, ±3% tolerance requires careful gap or material selection, consistent winding turns and positions and may need addition or removal of turns. Many times the part cannot attain the needed value and must be scrapped or disassembled and rewound.

In some embodiments, a toroid core of magnetic material is cut into two or more pieces. A non-magnetic, compressible material is positioned in the gaps between pieces, and an adjustable clamp clamps the gapped core together. The finished wound core is adjusted and cured to fix the set value. The present design allows for adjustment of the inductance value (a wide range of adjustment and fine control) before and after the coil is wound onto the toroidal core.

In one independent embodiment, an inductor may generally include a toroidal core defining two gaps to provide a removable core section, the core also including a rigid core section; gap material positioned in at least one of the gaps; and at least one winding wound on the rigid core section. After the at least one winding is wound on the rigid core section, at least one of the gaps is adjusted to adjust an inductance of the inductor.

In another independent embodiment, an inductor may generally include a toroidal core defining two gaps to provide a removable core section, the core also including a rigid core section; compressible gap material positioned in the gaps; at least one winding wound on the rigid core section; and force-applying structure operable to apply a force to the removable core section to adjust the gaps and thereby an inductance of the inductor.

In yet another independent embodiment, an inductor may generally include a wound toroidal core cut to define two gaps and provide a removable core section, the core also including a rigid core section; compressible gap material positioned in the gaps; at least one winding wound on the rigid core section; and at least one clamp operable to apply a force to the removable core section to compress the compressible material to adjust the gaps and thereby an inductance of the inductor.

In a further independent embodiment, a method of assembling an inductor may generally include forming a toroidal core defining two gaps to provide a removable core section, the core also including a rigid core section; positioning at least one winding on the rigid core section; and after positioning the at least one winding, adjusting at least one the gaps and thereby an inductance of the inductor.

In another independent embodiment, a method of assembling an inductor may generally include forming a toroidal core defining two gaps to provide a removable core section, the core also including a rigid core section; positioning compressible material in the gaps; positioning at least one winding on the rigid core section; and applying a force to the removable core section to adjust the gaps and thereby an inductance of the inductor.

In yet another independent embodiment, a method of assembling an inductor may generally include forming a wound toroidal core; cutting the core to define two gaps between a rigid core section and a removable core section; positioning compressible material in the gaps; positioning windings on the rigid core section; and applying a force to the removable core section with at least one clamp to adjust the gaps and thereby an inductance of the inductor.

Independent features and independent advantages of the invention will become apparent to those skilled in the art upon review of the detailed description, drawings and claims.

DETAILED DESCRIPTION

Figure 1:
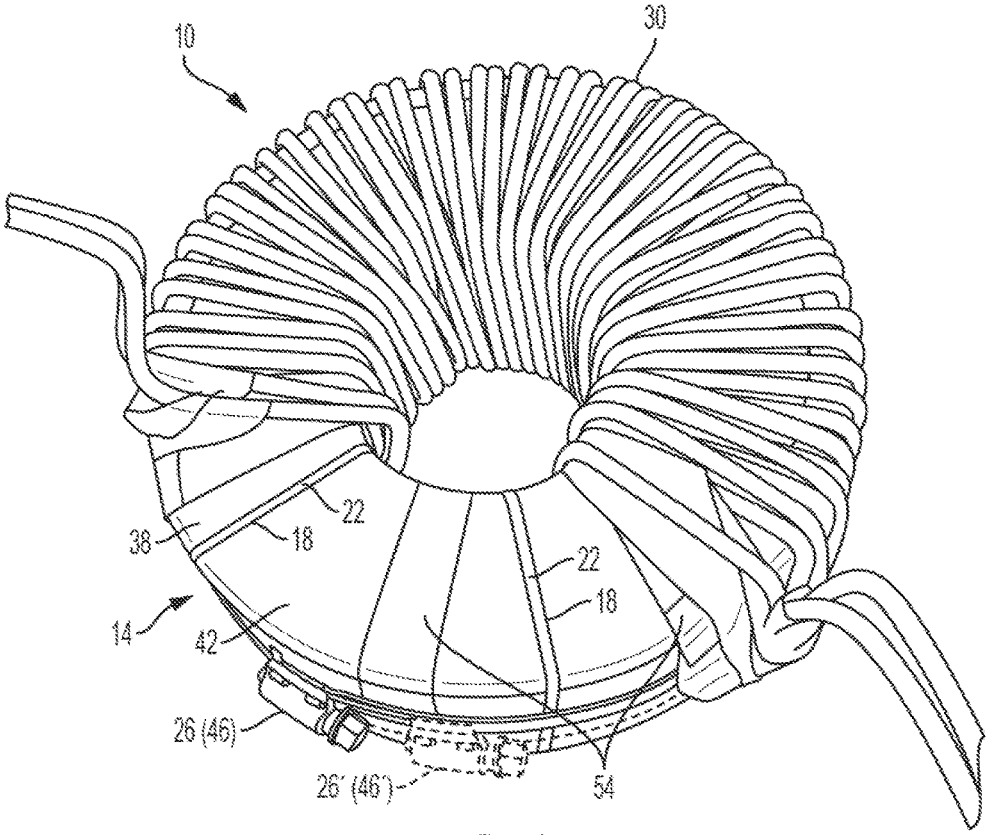
FIG. 1 is a perspective view of an adjustable inductor.
Figure 2:
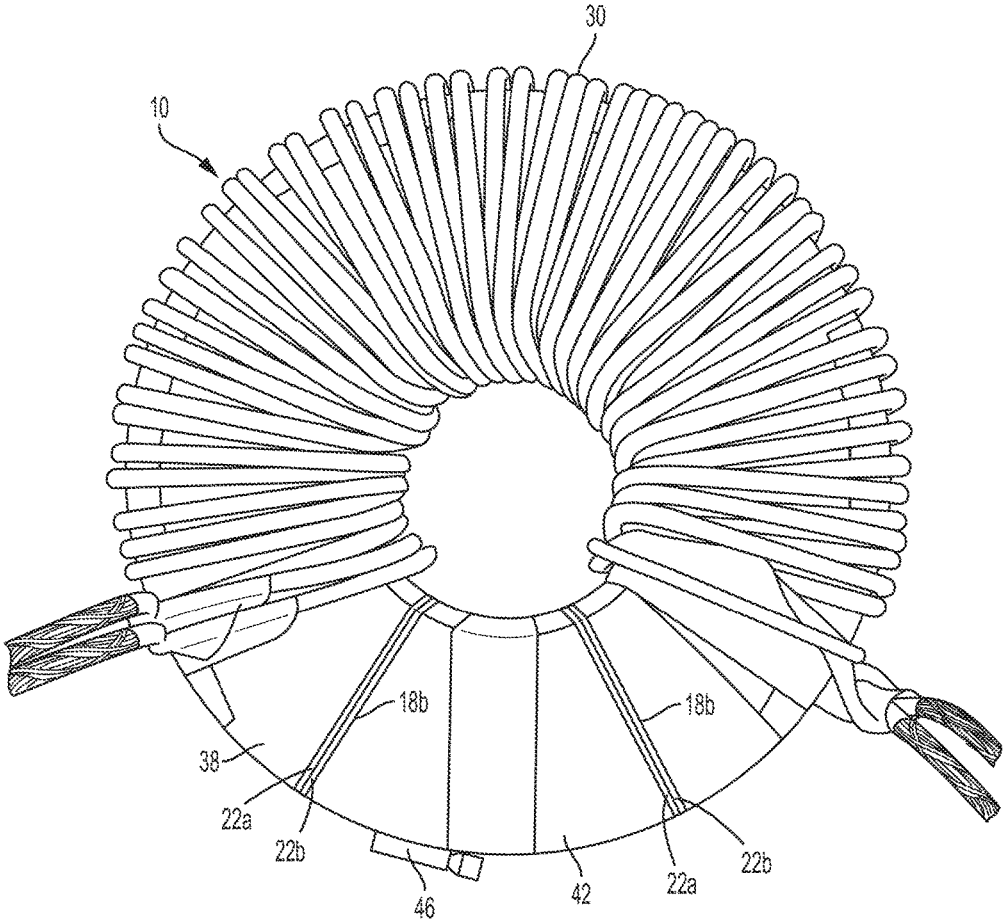
FIG. 2 is a top view of the inductor shown in FIG. 1.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

An electrical component, such as a toroidal inductor 10, and a method of assembling the inductor 10 are illustrated in FIGS. 1-6. The illustrated inductor 10 is adjustable to adjust its inductance. The inductor 10 generally includes (see FIGS. 1-2) a core 14 defining a number of gaps 18, gap material 22 positioned in the gaps 18, force-applying structure 26 (e.g., a hose clamp) to adjust the gap(s) 18, and a wound coil 30.

In the illustrated construction, the core 14 has a toroidal shape and defines at least two gaps 18 (four gaps 18 shown in FIGS. 3-4) to provide core pieces 34 (four core pieces 34, two of about 120° each and two of about 60° each). In other constructions (not shown), the core 14 may be formed in different angular sections (e.g., four 90° core pieces 34) and/or with fewer or more gaps 18 (e.g., six 60° core pieces 34).

The illustrated core 14 is formed by winding strip steel (e.g., M3, M6, M50 or other grade) which is spot welded and annealed. The layers of the core 14 are held together, for example, by varnish. The core 14 is then cut to provide the desired number of gaps 18.

In other constructions (not shown), the core 14 may be formed of different materials (e.g., amorphous sheet, iron powder, Sendust powder, etc.) and/or by different processes (e.g., molding, casting, etc.). In such constructions, the core 14 may be formed (e.g., molded, compressed and fired) with the desired gap(s) 18.

Figure 3:
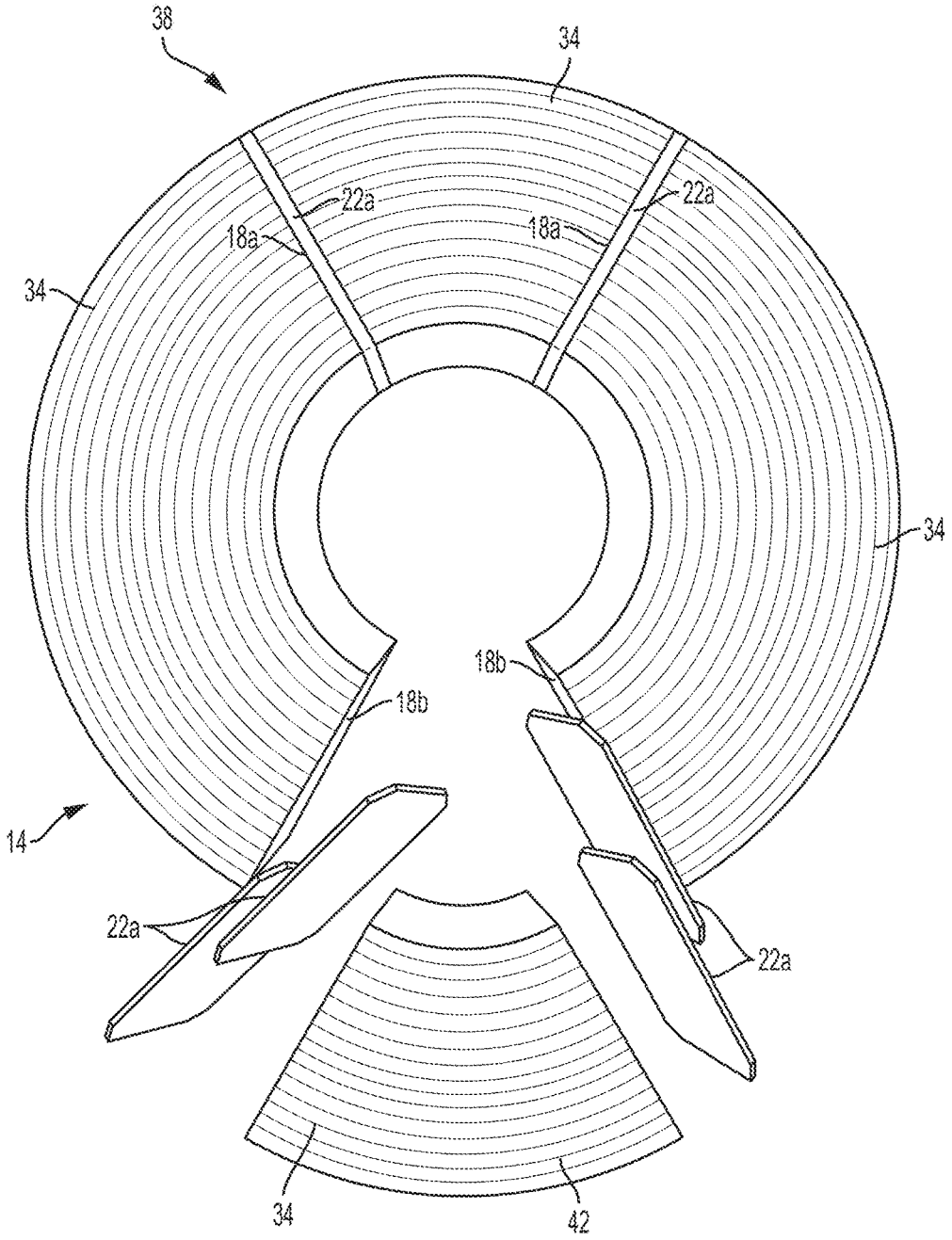
FIG. 3 is a top view of a core of the inductor partially assembled with gap material.
Figure 4:
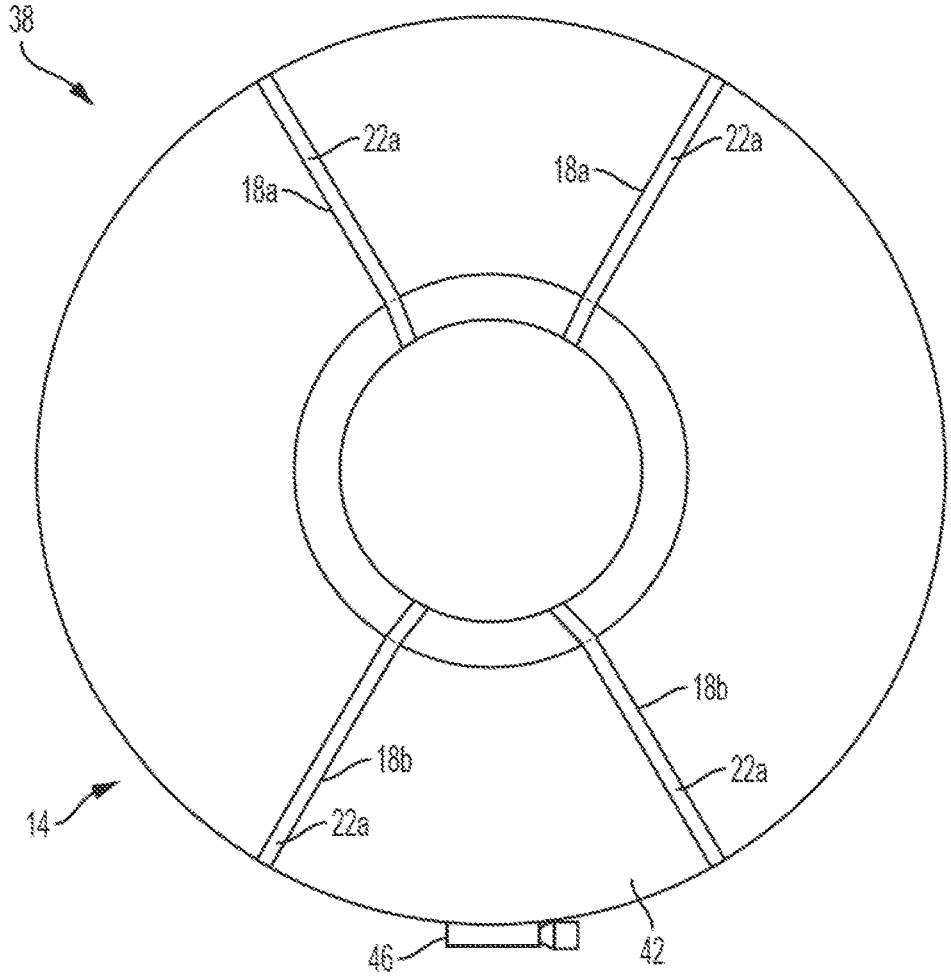
FIG. 4 is a top view of the core assembled with gap material and a clamp.
Figure 5:
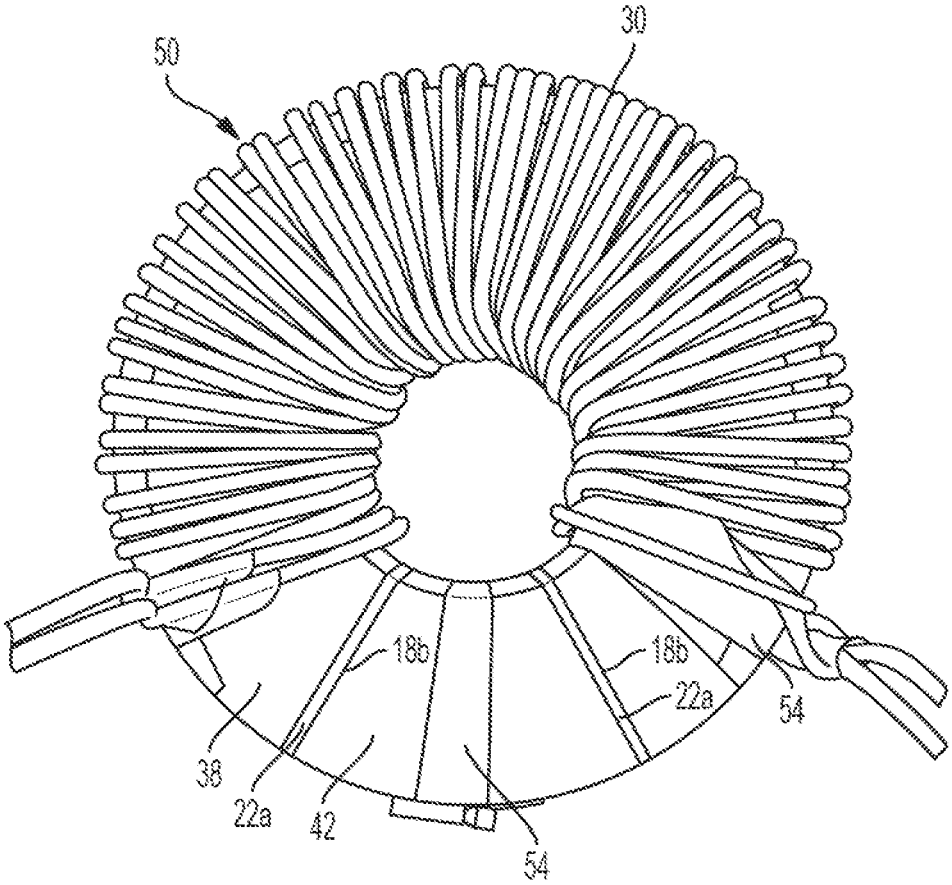
FIG. 5 is a top view of the wound core.
Figure 6:
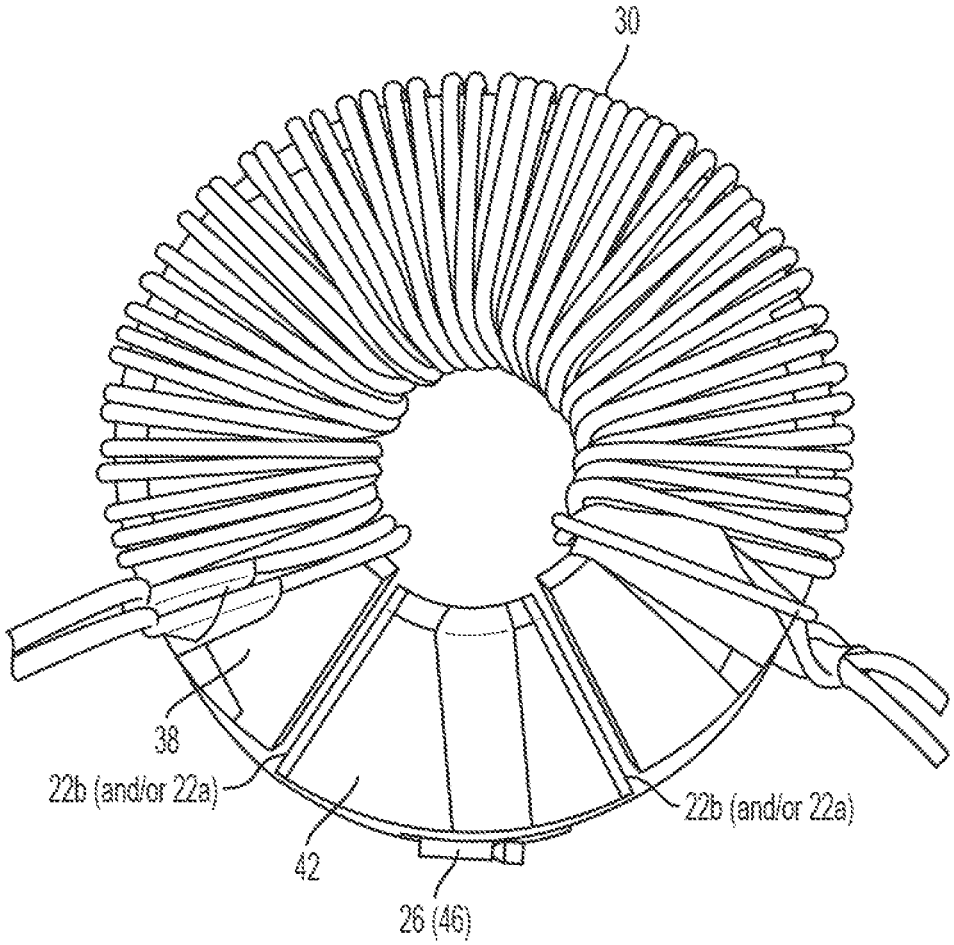
FIG. 6 is a top view of the wound core with a removable core section partially removed.

As shown in FIGS. 3-4, gap material 22 is positioned in each of the gaps 18. The gap material 22 is substantially non-magnetic and not electrically conductive. The gap material 22 also withstands magnetic temperatures (maximum temperatures in the range of about 130° C. to about 220° C.) and may perform to cold temperatures (as low as about −55° C.).

Substantially incompressible "rigid" gap material 22*a* (e.g., high temperature gapping material used in magnetics (glass epoxy, Glastic® (available from Rochling Glastic Composites, L.P., Cleveland, Ohio), GPO fiberglass epoxy, Nomex® paper (available from DuPont, Wilmington, Del.), circuit board material, etc., glass, treated paper, and combinations thereof)), is placed in fixed gaps 18*a* (e.g., gaps 18 which are not to be adjustable) (see FIGS. 3-4). In the illustrated construction, the thickness of gap material 22*a* in the fixed gaps 18*a* is selected to establish a basic inductance and an inductance adjustability range of the inductor 10.

For holding purposes during assembly, rigid gap material 22*a* is positioned in the adjustable gaps 18*b*. Compressible "soft" gap material 22*b* (e.g., silicone sheet, silicone foam, high temperature soft rubber, etc. and combinations thereof) may later be provided in the adjustable gap(s) 18*b* (see FIGS. 2 and 6).

A rigid core section 38 is formed by fixing rigid gap material 22*a* in place (e.g., with high temperature glue) between a number of separated pieces 34 (e.g., three pieces 34) of the core 14. Rigid gap material 22*a* is also removably positioned (e.g., unglued; see FIGS. 3-4) in the gaps 18*b* during assembly (e.g., through winding) and may be used, alone or in combination with soft gap material 22*b*, in the final adjustable gap(s) 18*b*.

The core 14 is assembled of one or more rigid core sections 38 and at least one removable core section 42. In the illustrated construction (see FIGS. 3-4), the core 14 includes a rigid core section 38 extending about 300° (e.g., three core pieces 34 of about 120°, 60° and) 120° and a removable core section 42 extending about 60°. In other constructions (not shown), the core sections 38, 42 may subtend a different angle (e.g., about 270° and about 90°, respectively).

In the illustrated construction (see, e.g., FIGS. 1-2 and 6), the force-applying structure 26 includes a clamp 46 (e.g., a hose clamp) positioned at least partially around the core 14 (e.g., around the circumference of the core 14). The clamp 46 is non-magnetic (e.g., stainless steel, aluminum, etc.) and generally holds the sections 38, 42 of the core 14 together. When tightened (see FIGS. 1-2), the clamp 46 is operable to apply a force (e.g., a radial force) to the removable section 42 of the core 14 to adjust the gap(s) 18*b*.

In the illustrated construction, the force-applying structure 26 includes only one clamp 46. In other constructions, more than one clamp 46 (e.g., two (an additional force-applying structure 26'/clamp 46' is shown in phantom in FIG. 1), three or more) may be provided. As shown in FIG. 1, the actuating portions of the force-applying structures 26, 26' (the clamps 46, 46') are illustrated circumferentially-spaced apart but, in other constructions (not shown), may be circumferentially-aligned.

In other constructions (not shown), the force-applying structure 26 may include another mechanism, such as a radially-oriented screw (e.g., a thumb screw) supported on a circumferential band, applying a radial force to the removable section 42. In other constructions (not shown), the force-applying structure 26 may include a cable tie, a tie strap, banding material applied by a banding machine, etc.

The wound coil 30 includes (see FIGS. 1-2 and 5-6) one or more windings 50 wound onto the rigid core section 38 but not onto the removable core section 42. The windings 50 may include wire that is coated with film, Teflon® (available from DuPont), other material withstanding magnetic temperatures, glass wound, etc. Each winding 50 has a desired number of turns, strands of wire (e.g., a single strand, multiple strands), etc. In the illustrated construction, the coil 30 includes dual windings 50. The number of core pieces 34 and the relative sizes of the core sections 38, 42 may be determined based on the desired size of the coil 30 on the rigid core section 38.

Prior to winding, the rigid core section 38 is wrapped (with tape 54), dipped, epoxy, other coating, etc., to be electrically insulated. In the illustrated construction, the removable core section 42 is wrapped with one or more strips of tape 54 separately from the rigid core section 38.

With the core sections 38, 42 held rigidly by the clamp 46 (to withstand wrapping forces), the windings 50 are wound, in the illustrated construction (see FIG. 5), only onto the rigid core section 38 with the desired number of turns. In other constructions (not shown), the windings 50 may be wound onto a portion of the removable core section 42.

After winding, the clamp 46 is loosened (see FIG. 6), and the rigid gap material 22*a* in at least one of the gaps 18*b* (both adjustable gaps 18*b* in the illustrated construction) is replaced with soft gap material 22*b* (see FIG. 2) or a combination of soft and rigid gap materials 22*b*, 22*a*. The clamp 46 is tightened to set a low end of adjustment of the gap(s) 18*b* and of the inductance.

The clamp 46 is adjusted (e.g., tightened to increase the inductance, loosened to decrease the inductance) to radially move the removable core section 42 to adjust the gap(s) 18*b* (in the illustrated construction, both gaps 18*b* are adjusted) and, thereby, the inductance of the inductor 10 to the desired value. In the illustrated construction, the inductance of the inductor 10 can be adjusted in a range of 10% of the inductance value. This range of adjustment can be changed with a different size of the adjustable gap(s) 18*b*, amount or compressibility of the compressible gap material 22*b*, etc.

In an alternative construction, the adjustable gap(s) 18*b* can be adjusted with only rigid gap material 22*a*. After winding, the thickness of rigid gap material 22*a* in the adjustable gap(s) 18*b* is changed to change the inductance. The thickness (the number of sheets and/or thickness of each sheet of rigid gap material 22*a*) is changed until the desired inductance is achieved.

In the illustrated construction, once the inductance value is set, the inductor 10 is finished (e.g., varnish dipped, epoxy coated and baked or cured) to rigidly set the inductance. It should be understood that, in other constructions (not shown), the inductor 10 may not undergo finishing, and such an inductor 10 would remain adjustable during use.

Thus, the invention may generally provide, among other things, an adjustable inductor 10 and a method of assembling such an inductor 10. One or more independent features and independent advantages of the invention may be set forth in the claims.

What is claimed is:

1. An inductor comprising:

a toroidal core defining a plurality of gaps to provide one or more removable core sections, the core also including at least one rigid core section;

compressible gap material positioned in the gaps;

at least one winding wound on the at least one rigid core section, the winding having a first end and a second end forming a gap in the winding, wherein the one or more removable core sections are positioned within the gap in the winding; and a force-applying structure positioned around a circumference of the toroidal core and operable to apply a circumferential force to the toroidal core along at least two radii of the toroidal core to adjust the gaps and thereby an inductance of the inductor.

2. The inductor of claim 1, wherein the core includes one of wound strip steel, powdered core material or distributed gap material.

3. The inductor of claim 2, wherein the core is formed of wound strip steel and cut to provide the gaps.

4. The inductor of claim 1, wherein the core defines at least four gaps to provide a corresponding number of core pieces.

5. The inductor of claim 4, wherein the core defines four gaps to provide four core pieces.

6. The inductor of claim 4, wherein one of the core pieces subtends a first angle and another of the core pieces subtends a second angle different than the first angle.

7. The inductor of claim 4, wherein the rigid core section is formed of three core pieces, and wherein the inductor further comprises rigid gap material fixed in the gaps between the three core pieces of the rigid core section.

8. The inductor of claim 7, wherein the rigid gap material is glued to the core pieces of the rigid core section.

9. The inductor of claim 7, wherein the rigid core material includes high temperature gapping material used in magnetics.

10. The inductor of claim 9, wherein the gapping material includes one of glass epoxy, GPO fiberglass epoxy, circuit board material, glass, treated paper, or combinations thereof.

11. The inductor of claim 1, wherein the compressible gap material includes one of silicone sheet, silicone foam, high temperature soft rubber, or combinations thereof.

12. The inductor of claim 1, wherein rigid gap material is positioned with the compressible gap material in the gaps.

13. The inductor of claim 1, wherein each of the at least one winding includes multiple strands of wire.

14. The inductor of claim 1, wherein the at least one winding includes dual windings.

15. The inductor of claim 1, wherein the force-applying structure includes one of a clamp, a cable tie, a tie strap or banding material.

16. The inductor of claim 15, wherein the force-applying structure includes at least one clamp.

17. The inductor of claim 16, wherein the at least one clamp includes a hose clamp.

18. The inductor of claim 17, wherein the at least one clamp includes two hose clamps positioned around the circumference of the core, the hose clamps being spaced apart along an axis of the core.

19. An inductor comprising:

a wound toroidal core cut to define a plurality of gaps and provide one or more removable core sections, the core also including at least one rigid core section;

compressible gap material positioned in the gaps;

at least one winding wound on the at least one rigid core section, the winding having a first end and a second end forming a gap in the winding, wherein the one or more removable core sections are positioned within the gap in the winding; and at least one clamp positioned around a circumference of the toroidal core and operable to apply a circumferential force to the toroidal core along at least two radii of the toroidal core to compress the compressible material to thereby adjust the gaps and an inductance of the inductor.

20. The inductor of claim 19, wherein the core is cut to define four gaps and provide four core pieces.

21. The inductor of claim 20, wherein one of the core pieces subtends a first angle and another of the core pieces subtends a second angle different than the first angle.

22. The inductor of claim 20, wherein the rigid core section is formed of three core pieces, and wherein the inductor further comprises rigid gap material glued in the gaps between the three core pieces of the rigid core section.

23. The inductor of claim 19, wherein the compressible gap material includes one of silicone sheet, silicone foam, high temperature soft rubber, or combinations thereof.

24. The inductor of claim 19, wherein rigid gap material is positioned with the compressible gap material in the gaps.

25. The inductor of claim 19, wherein the at least one clamp includes at least one hose clamp.

26. A method of assembling an inductor, the method comprising:

forming a toroidal core defining two gaps to provide a removable core section, the core also including a rigid core section;

positioning at least one winding, having a first end and a second end forming a gap in the winding, on the rigid core section such that the one or more removable core sections are positioned within the gap in the winding; and after positioning the at least one winding, applying a circumferential force to the toroidal core along at least two radii of the toroidal core to adjust at least one of the gaps and thereby an inductance of the inductor.

* * * * *